US006948260B2

(12) United States Patent
Lin et al.

(10) Patent No.: US 6,948,260 B2
(45) Date of Patent: Sep. 27, 2005

(54) 3D AIR-PUMPING SHOE

(75) Inventors: Hsi-Liang Lin, PO Box 82-144, Taipei (TW); Ming-Hsiung Lin, PO Box 82-144, Taipei (TW)

(73) Assignees: Hsi-Liang Lin, Taipei (TW); Ming-Hsiung Lin, Taipei (TW); Chao-Yung Chan, Taipei (TW)

( * ) Notice: Subject to any disclaimer, the term of this patent is extended or adjusted under 35 U.S.C. 154(b) by 11 days.

(21) Appl. No.: 10/744,002

(22) Filed: Dec. 24, 2003

(65) Prior Publication Data

US 2005/0138838 A1 Jun. 30, 2005

(51) Int. Cl.[7] ..... A43B 7/06
(52) U.S. Cl. ..... 36/3 B
(58) Field of Search ..... 36/3 B, 3 R, 3 A

(56) References Cited

U.S. PATENT DOCUMENTS 4,894,932 A * 1/1990 Harada et al. ..... 36/3 R
6,305,100 B1 * 10/2001 Komarnycky et al. ..... 36/3 R
2001/0007176 A1 * 7/2001 Attilieni ..... 36/3 B
2003/0150131 A1 * 8/2003 McManus et al. ..... 36/28
2004/0078996 A1 * 4/2004 Brooks ..... 36/3 B
2004/0163277 A1 * 8/2004 Saiz Zapata ..... 36/3 B

* cited by examiner

*Primary Examiner*—Ted Kavanaugh
(74) *Attorney, Agent, or Firm*—Leong C. Lei

(57) ABSTRACT

A 3D air-pumping shoe having a first and a second chambers respectively on the rear and the front of the outsole; at lease one ventilation outlet being disposed on the side walls of both chambers for external connection; an air unit being each disposed in the first chamber and the second chamber, each air unit containing multiple laterally disposed air ducts that connecting through those ventilation outlets on the side walls of the outsole; and a waterproof air permeable film and a air permeable cushion being paved in sequence above the air unit.

3 Claims, 3 Drawing Sheets

3D AIR-PUMPING SHOE

BACKGROUND OF THE INVENTION (a) Technical Field of the Invention

The present invention is related to an improved 3D air-pumping shoe, and more particularly to one that has respectively provided a first air unit and a second air unit in the front and the rear sections of the outsole of the shoe to allow air passage into the shoe or expel hotter air of the shoe into the atmosphere.

(b) Description of the Prior Art

Whereas one usually gets uncomfortable after wearing a pair of shoes for a long time due to the heat accumulated inside the shoes, air unit containing an air chamber is provided to the outsole to produce air-pumping effects by keeping compressing the air chamber while one walks or runs so to expel the hot air out of the shoes into the ambient.

As taught by an application titled "3D Multi-purpose Air-pumping Shoe" filed by the applicant of the present invention, a shoe has in its outsole provided with multiple recessed air chambers and a primary air chamber connected through one another; multiple air ducts are cut on the peripheral side walls surrounding each air chamber so to connect through the air current flowing between any two given air chambers. A mid sole disposed with multiple ventilation outlets directly in symmetric to those provided on a cushion is provided over the outsole to such extent allowing the projection of those multiple ventilation outlets fall at where over the air chambers. Multiple beads protrude from the top of the cushion and the cushion is provided with multiple through outlets while multiple groups of protrusions extend downward from the bottom, and is paved over the mid sole. A compression point to pump the air is form beneath the projection of each protruded bead so to pump the air on each step into the shoes and pass through those ventilation outlets, air chambers and air ducts to achieve ventilation vertically and laterally while expelling the hot air in the shoe to the ambient for creating 3D ventilation results and maintaining refresh and comfortable wearing of the shoe while massaging one's foot. However, the prior art described above though achieving the ventilation purpose for the show is found with the following flaws. Firstly, the outsole must be molded with air chambers and air ducts connecting through one another resulting in very expensive in the development of the mold for the outsole to increase the production cost. Secondly, the design of the air chambers must be changed whenever the shape of the outsole changes to waive the original design to render more problems to the production of the shoe.

SUMMARY OF THE INVENTION

The primary purpose of the present invention is to provide an improved structure of a 3D air-pumping shoe essentially comprised of an outsole a first air unit, and a second air unit. Wherein, a first air chamber is provided in recess on the top of the heel section of the outsole; a second air chamber is provided in recess on the top of the sole of the foot, and at least one ventilation outlet is provided on the sidewalls of the first and the second air chambers to connect through the ambient. The first air unit containing a body is provided merely striding over the first air chamber and multiple air ducts are laterally provided on the body of the first air unit to connect those air ventilation outlets provided on the sidewalls of the outsole. A waterproof air permeable film and an air cushion are paved in sequence over the body of the first air unit. The second air unit containing a body merely is provided merely striding over the second air chamber and multiple air ducts are laterally provided on the body of the second air unit to connect those air ventilation outlets provided on the sidewalls of the outsole. A waterproof air permeable film and an air cushion are paved in sequence over the body of the second air unit.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
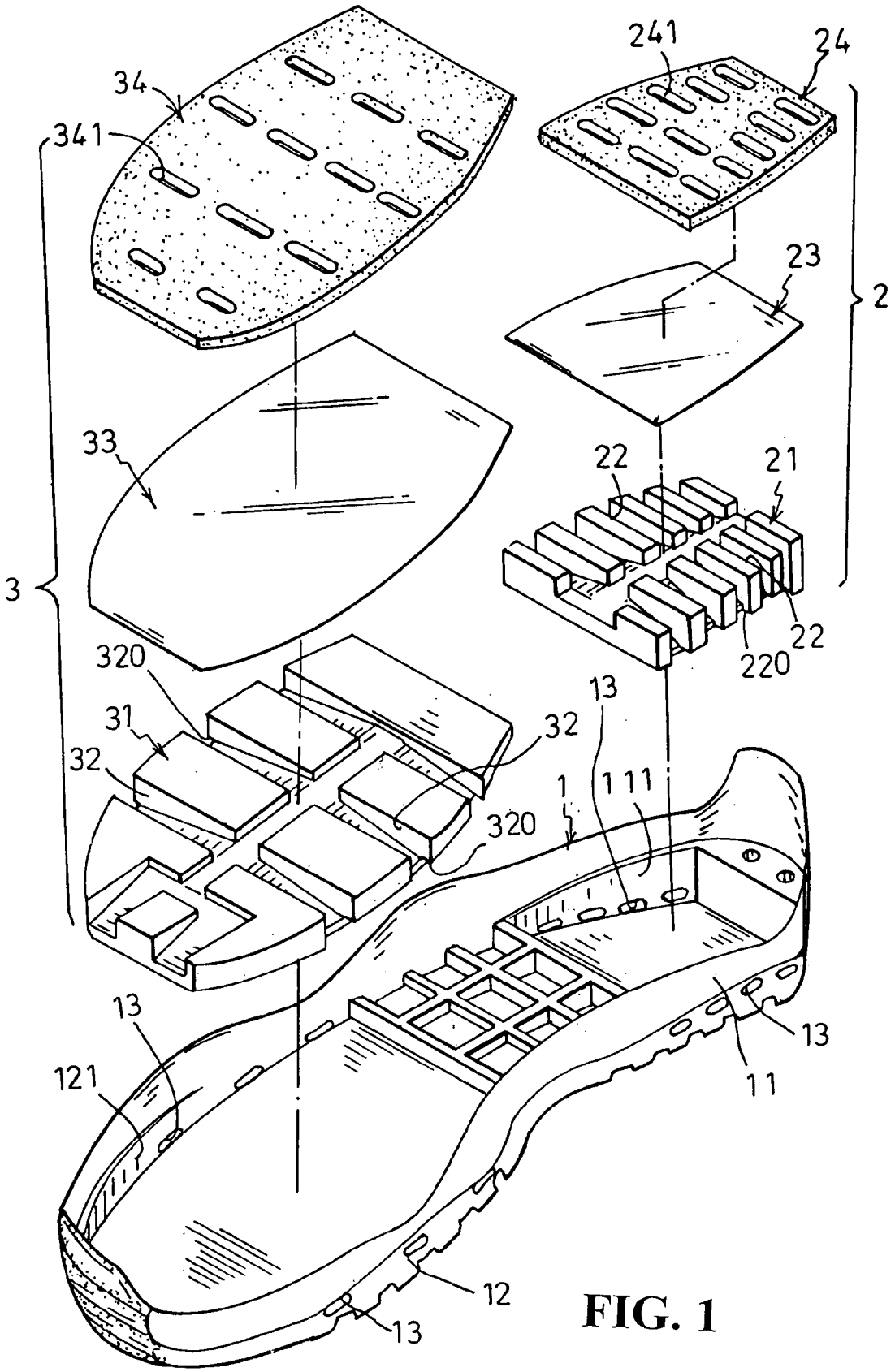
FIG. 1 is an exploded view of a preferred embodiment of the present invention.
Figure 2:
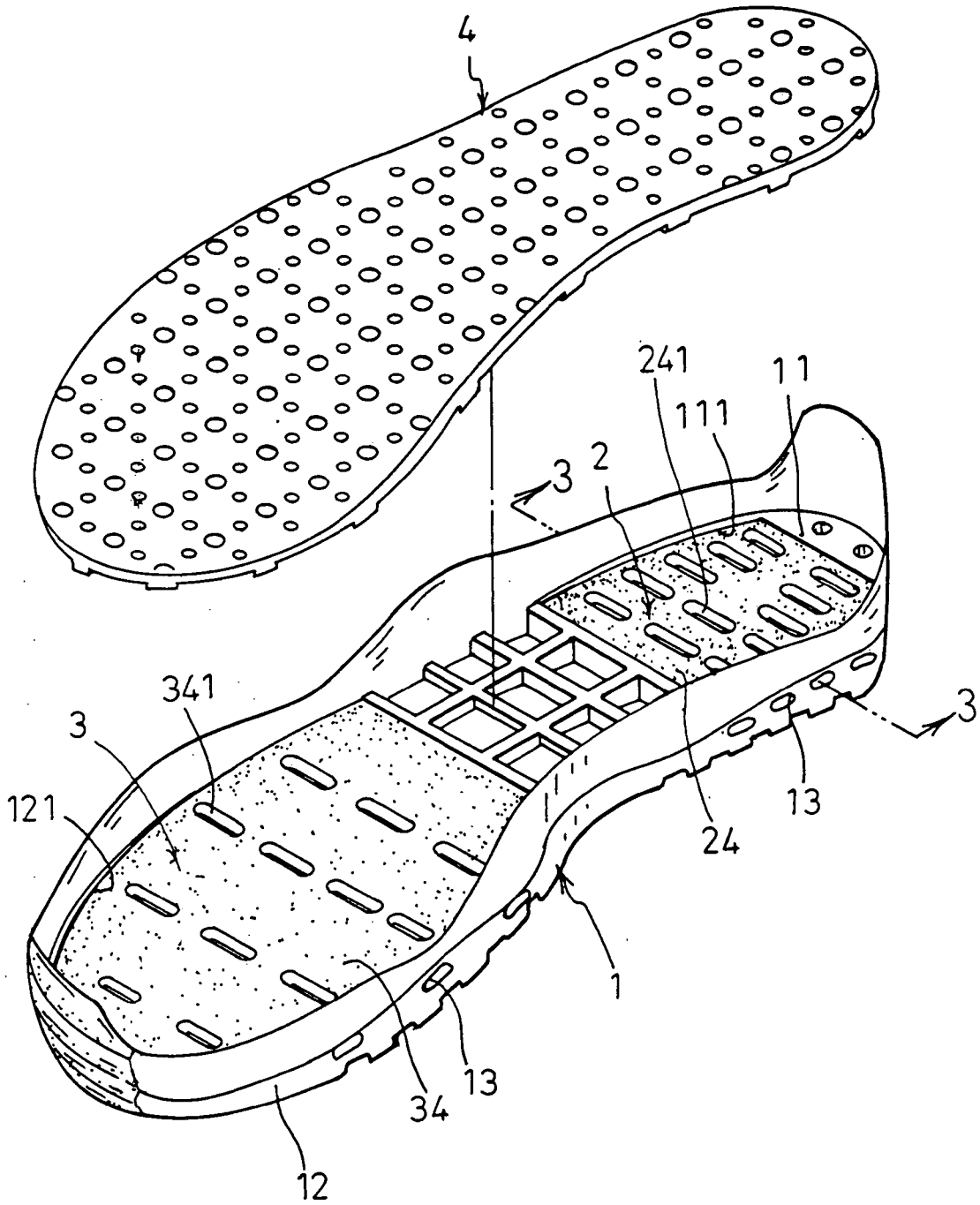
FIG. 2 is a perspective view of the preferred embodiment of the present invention.
Figure 3:
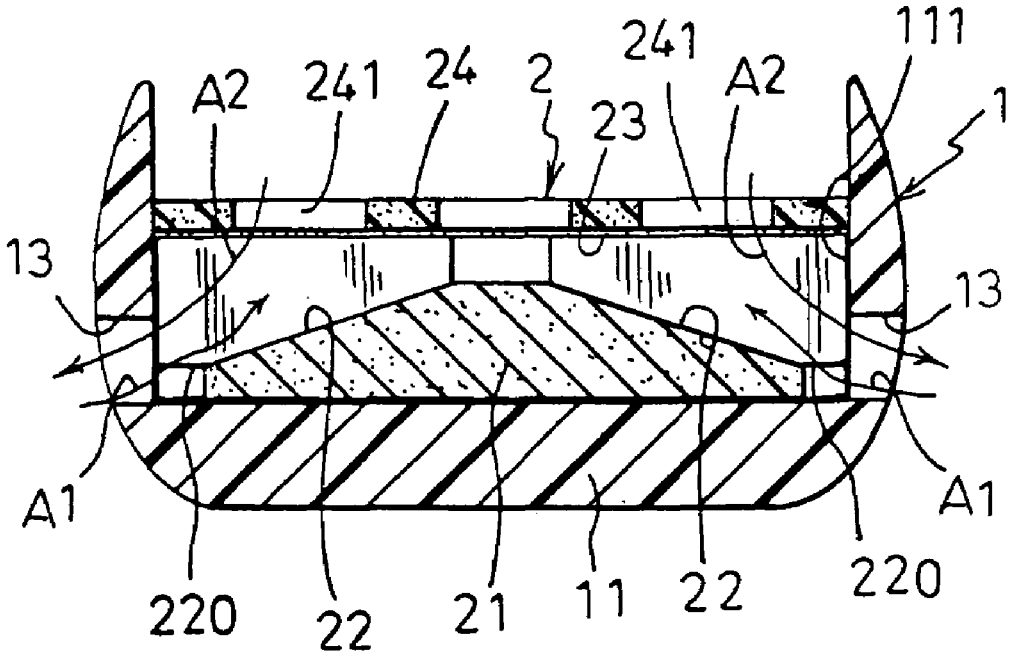
FIG. 3 is a sectional view taken from 3—3 in FIG. 2.

Referring to FIGS. 1, 2 and 3, for a preferred embodiment of the present invention, an improved structure of a 3D air-pumping shoe has its outsole containing an outsole (1), a first air chamber (111) is provided in recess on the heel section of the outsole (1) and a second air chamber (121) is provided in recess on the foot sole section (12) of the outsole (1). At least one ventilation outlet (13) is provided respectively on the sidewalls of the first and the second air chambers (111, 121) to connect through the ambient. A first air unit (2) contains a body (21) and merely strides over the first air chamber (111), and multiple air ducts (22) are laterally provided in recess on the body (21) of the first air unit (2) to connect through the ventilation outlet (13) on the sidewall of the outsole (1). A waterproof, air permeable film (23) and an air cushion (24) are paved in sequence over the body (21) of the first air unit (2). A second air unit (3) contains a body (31) and merely strides over the second air chamber (121), and multiple air ducts (32) are laterally provided in recess on the body (31) of the second air unit (3) to connect through the ventilation outlet (13) on the sidewall of the outsole (1). A waterproof, air permeable film (33) and an air cushion (34) are paved in sequence over the body (31) of the second air unit (3).

The outsole (1) is made in one piece to fit any type of shoes, including a sneaker, and leather shoes.

The body (21) of the first air unit (2) is made by compromising the shape of the first air chamber (111) of the outsole (1) so to merely stride over the first air chamber (111). Multiple air ducts (22) are laterally provided in recess on the body (21) of the first air unit (2) and the lower ends (220) of all those multiple air ducts (22) are connected through one another. The projection of at least one air duct (22) is merely aligned at the air ventilation outlet (13) on the sidewall of the outsole (1) to allow the cool air (A1) in the ambient to enter into the shoe through the ventilation outlet (13) and the air duct (22) while expelling the hot air (A2) into the ambient through the ventilation outlet (13). The waterproof, air permeable films (23, 33) respectively paved on the first and the second air units (2, 3) has the porosity smaller than the water molecule so to stop the water penetrating into the outsole (1) at where below the waterproof, air permeable films (23, 33) to keep dry and clean of the shoe. Whereas the waterproof, air permeable film is related to an object of the prior art, it will not be elaborated herein.

The cushions (24, 34) respectively paved on the waterproof, air permeable films (23, 33) of the first and the second air units (2, 3) are made of foaming materials, woven fabric, non-woven fabric, sheet film, etc. Multiple pores (241, 341) are respectively provided on the cushions (24, 34) to communicate the air inside the shoe and that from the ambient.

The second air unit (3) of the present invention contains a body (31) and the shape of the body (31) compromises that of the second air chamber (121) of the outsole (1) so to merely stride over the second air chamber (121). Multiple air ducts (32) are laterally provided in recess on the body (31) of the second air unit (3) and the lower ends (320) of all those multiple air ducts (32) are connected through one another. The projection of at least one air duct (32) is merely aligned at the air ventilation outlet (13) on the sidewall of the outsole (1) to allow the cool air (A1) in the ambient to enter into the front end of the shoe through the ventilation outlet (13) and the air duct (32) while expelling the hot air (A2) into the ambient through the ventilation outlet (13).

The present invention is essentially related to make improvement for the "3D Multi-purpose Air-pumping Shoe" (ROC Utility Patent No. 83202775) of the same applicant of the present invention. In the present invention, the second air chamber and the first air chamber (121, 11) are respectively provided in the front and the rear of the outsole (1) to accommodate respectively the second and the first air units (3, 2) so that the first and the second air units (2, 3) each become an independent component. In the development of the outsole, the production problem of the air duct as taught in the utility patent specified above can be disregarded for lowering the cost of the development of the mold for the outsole (1) and for achieving a simple structure of the mold to reduce the cost of the development of the mold. Furthermore, both of the first and the second air units may be removed to be adapted to other types of shoes. For example, in case of any damaged to the existing air pumping device, it can be replaced with the first and the second air units disclosed in the present invention; or the first and the second air units may be replaced with air pumping devices or any other air exchange devices of the prior art in the first and the second air chambers of the present invention. That is, with the innovation and creativity of the present invention, the manufacturer may decide on the type of shoes depending on the individual order to meet economic benefits.

The present invention by having the front and the rear parts of the shoe to respectively provide the function of ventilation improves the ventilation efficiency in the shoe to make it more comfortable to wear.

As illustrated in FIG. 2, another cushion (4) is each provided on the top of the first and the second air units (2, 3). The cushion (4) is related to the air-pumping device taught in the utility patents (ROC Patent Nos. 82202277 and 83202775) of the same applicant of the present invention or any other cushions available.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An air-pumping shoe with a bottom sole; wherein, the bottom sole contains an outsole, a first air unit and a second unit; a heel section of the outsole being provided in recess with a first air chamber; a foot sole section of the outsole being provided in recess with a second air chamber; at least one ventilation outlet being provided each on the sidewalls of the first and the second air chambers to communicate to the ambient; the first air unit containing a body and merely striding over the first air chamber, multiple air ducts being laterally provided in recess on the body to connect through the ventilation outlet on the sidewall of the outsole, a waterproof, air permeable film and a cushion being provided in sequence over the body of the first air unit; and the second air unit containing a body and merely striding over the second air chamber, multiple air ducts being laterally provided in recess on the body to connect through the ventilation outlet on the sidewall of the outsole, a waterproof, air permeable film and a cushion being provided in sequence over the body of the second air unit.

2. The air-pumping shoe as claimed in claim 1, wherein, all the air ducts on the first air unit have lower ends connected through one another with at lease one air duct having a projection directly aligned at one of the ventilation outlets provided on the side wall of the outsole.

3. The air-pumping shoe as claimed in claim 1, wherein, all the air ducts on the second air unit have lower ends connected through one another with at lease one air duct having a projection directly aligned at one of the ventilation outlets provided on the side wall of the outsole.

* * * * *